US006837490B2

(12) United States Patent
Hirai et al.

(10) Patent No.: US 6,837,490 B2
(45) Date of Patent: Jan. 4, 2005

(54) PAPER FEEDING APPARATUS

(75) Inventors: Keisuke Hirai, Kyoto (JP); Masahiko Takeuchi, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 133 days.

(21) Appl. No.: 10/309,245

(22) Filed: Dec. 4, 2002

(65) Prior Publication Data

US 2003/0102623 A1 Jun. 5, 2003

(30) Foreign Application Priority Data

Dec. 5, 2001 (JP) ..... 2001-371146

(51) Int. Cl.[7] ..... B65H 1/16
(52) U.S. Cl. ..... 271/148
(58) Field of Search ..... 271/148

(56) References Cited

U.S. PATENT DOCUMENTS

| | | | | |
|---|---|---|---|---|
| 3,355,167 A | | 11/1967 | Reeves | |
| 4,349,186 A | * | 9/1982 | Nakamura | 271/18 |
| 6,065,745 A | * | 5/2000 | Casper et al. | 271/160 |

FOREIGN PATENT DOCUMENTS

| | | | | |
|---|---|---|---|---|
| DE | 532292 C | | 8/1931 | |
| DE | 547205 C | | 3/1932 | |
| DE | 42 16 627 A1 | | 11/1993 | |
| EP | 0 189 746 A1 | | 8/1986 | |
| GB | 2 204 301 A | * | 11/1988 | B65H/1/04 |
| GB | 2 267 081 A | * | 11/1993 | B65H/1/04 |
| JP | 59078013 | | 5/1984 | |
| JP | 5-186074 | | 7/1993 | |
| JP | 6-1456 | | 1/1994 | |
| JP | 6-179530 | | 6/1994 | |
| JP | 7-206168 | | 8/1995 | |
| JP | 08012099 | | 1/1996 | |

* cited by examiner

*Primary Examiner*—Donald P. Walsh
*Assistant Examiner*—Kenneth W. Bower
(74) *Attorney, Agent, or Firm*—McDermott Will & Emery LLP

(57) ABSTRACT

A paper feeding apparatus includes a first support member for supporting a central area of a lower surface of printing paper placed on a paper tray, second support members for supporting corner areas of the lower surface of the printing paper, sensors for detecting heights of an upper surface of the printing paper placed on the paper tray, motors rotatable based on signals from the sensors, and lift screws vertically movable by the motors. The second support members are connected to the lift screws to be vertically movable therewith, respectively.

2 Claims, 6 Drawing Sheets

PAPER FEEDING APPARATUS

BACKGROUND OF THE INVENTION

1. Field of the Invention

The present invention relates to a paper feeding apparatus having a sucker for holding, by suction, an upper surface of printing paper placed on a paper tray, and transporting the paper to a printing machine.

2. Description of the Related Art

In such a paper feeding apparatus, printing paper with one surface thereof already printed may be placed one sheet over another on the paper tray to have the other surface printed. At this time, the printing paper has an image-bearing central area thereof swelling upward, owing to the thickness of ink, relative to marginal areas. This results in a phenomenon that the upper surface of the printing paper is convexed. When the upper surface of the printing paper is convexed in this way, the sucker cannot properly hold the printing paper by suction. In the conventional paper feeding apparatus, therefore, wedge-shaped spacers are inserted between the printing paper and paper tray to level the upper surface of the printing paper.

However, the curve of the upper surface of printing paper varies with the number of sheets of printing paper placed on the paper tray. The wedge-shaped spacers must be changed or removed in the course of continuous printing. However, it is difficult to change or remove the spacers while the printing machine is performing a printing operation.

It is also possible to damage printing paper or the printing machine when the wedge-shaped spacers are inserted to inappropriate positions, or when the spacers are not removed before completion of a printing operation.

SUMMARY OF THE INVENTION

The object of the present invention, therefore, is to provide a paper feeding apparatus capable of easily maintaining an upper surface of printing paper level to enable an accurate paper feeding operation.

The above object is fulfilled, according to the present invention, by a paper feeding apparatus for transporting an uppermost sheet and then a next sheet of printing paper placed on a paper tray to a printing machine, comprising a first support member for supporting a partial area of a lower surface of the printing paper placed on the paper tray, second support members for supporting areas of the lower surface of the printing paper placed on the paper tray other than the area supported by the first support member, and a moving mechanism for vertically moving the second support members relative to the first support member.

This paper feeding apparatus is capable of easily maintaining the upper surface of the printing paper level to enable an accurate paper feeding operation.

In a preferred embodiment, the second support members support the lower surface at least at corners of the printing paper picked up by a sucker.

Preferably, the second support members are arranged to support the lower surface at four corners of the printing paper.

In another aspect of the invention, a paper feeding apparatus is provided for transporting printing paper, with an upper surface thereof picked up by a sucker, placed on a paper tray to a printing machine. This apparatus comprises a first support member for supporting a central area of a lower surface of the printing paper placed on the paper tray, second support members for supporting corner areas of the lower surface of the printing paper placed on the paper tray, and a moving mechanism for vertically moving the second support members relative to the first support member.

Other features and advantages of the present invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
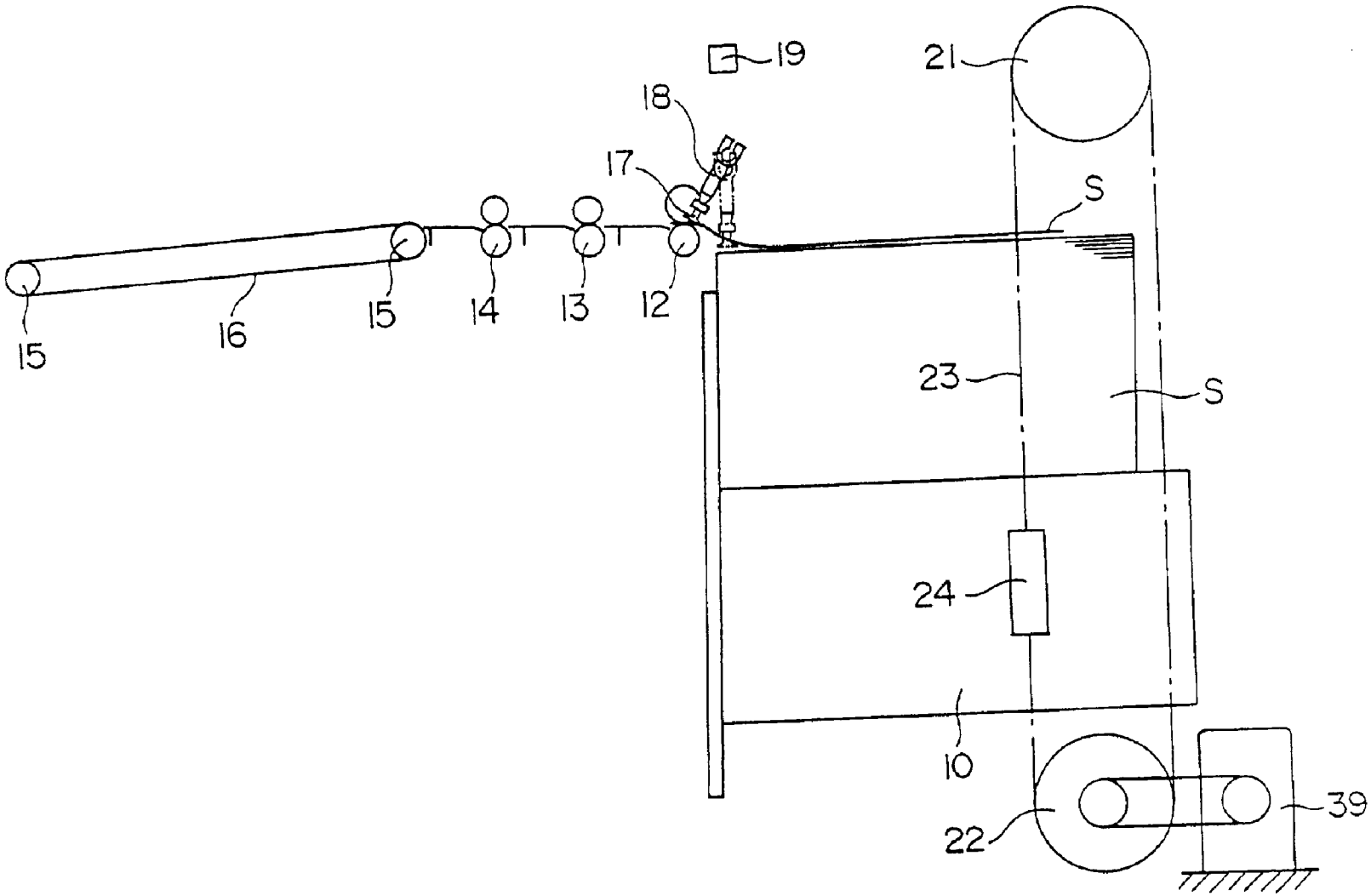
FIG. 1 is a side view of a paper feeding apparatus in a first embodiment of the invention.

An embodiment of the present invention will be described hereinafter with reference to the drawings. FIG. 1 is a side view of a paper feeding apparatus in a first embodiment of the invention.

This paper feeding apparatus includes a paper tray 10 for supporting printing paper S thereon, a transport mechanism having a plurality of roller pairs 12, 13 and 14 and an endless belt 16 wound around and extending between a pair of rollers 15, a sucker 18 reciprocable between a position shown in solid lines and a position shown in phantom lines in FIG. 1, and sensors 19 for detecting heights of an upper surface of printing paper S.

The sensors 19 are arranged along an end of the printing paper S to be picked up and held by the sucker 18, and are capable of detecting at least heights of a central area and opposite ends of the printing paper S. Preferably, the sensors 19 are disposed adjacent the sucker 18 (see FIGS. 2 and 3 to be described hereinafter). These sensors 19 may, for example, be ultrasonic sensors capable of detecting heights of the printing paper S in a noncontact mode.

The paper tray 10 is connected to a chain 23 through a connecting member 24, the chain 23 being wound around a drive sprocket 22 rotatable by a motor 39 described hereinafter, and a driven sprocket 21. Thus, the paper tray 10 is driven by the drive sprocket 21 to move vertically.

In this paper feeding apparatus, the printing paper S on the paper tray 10 is picked up adjacent an edge of the upper surface thereof by a suction pad 17 of the sucker 18, and is transported in this state to a position to be pinched between the roller pair 12. Then, the printing paper S is transported by the transport mechanism having the plurality of roller pairs 12, 13 and 14 and endless belt 16, to a printing machine at a downstream stage. The paper tray 10 is raised as the height of the upper surface of printing paper S varies with progress of a printing operation.

Figure 2:
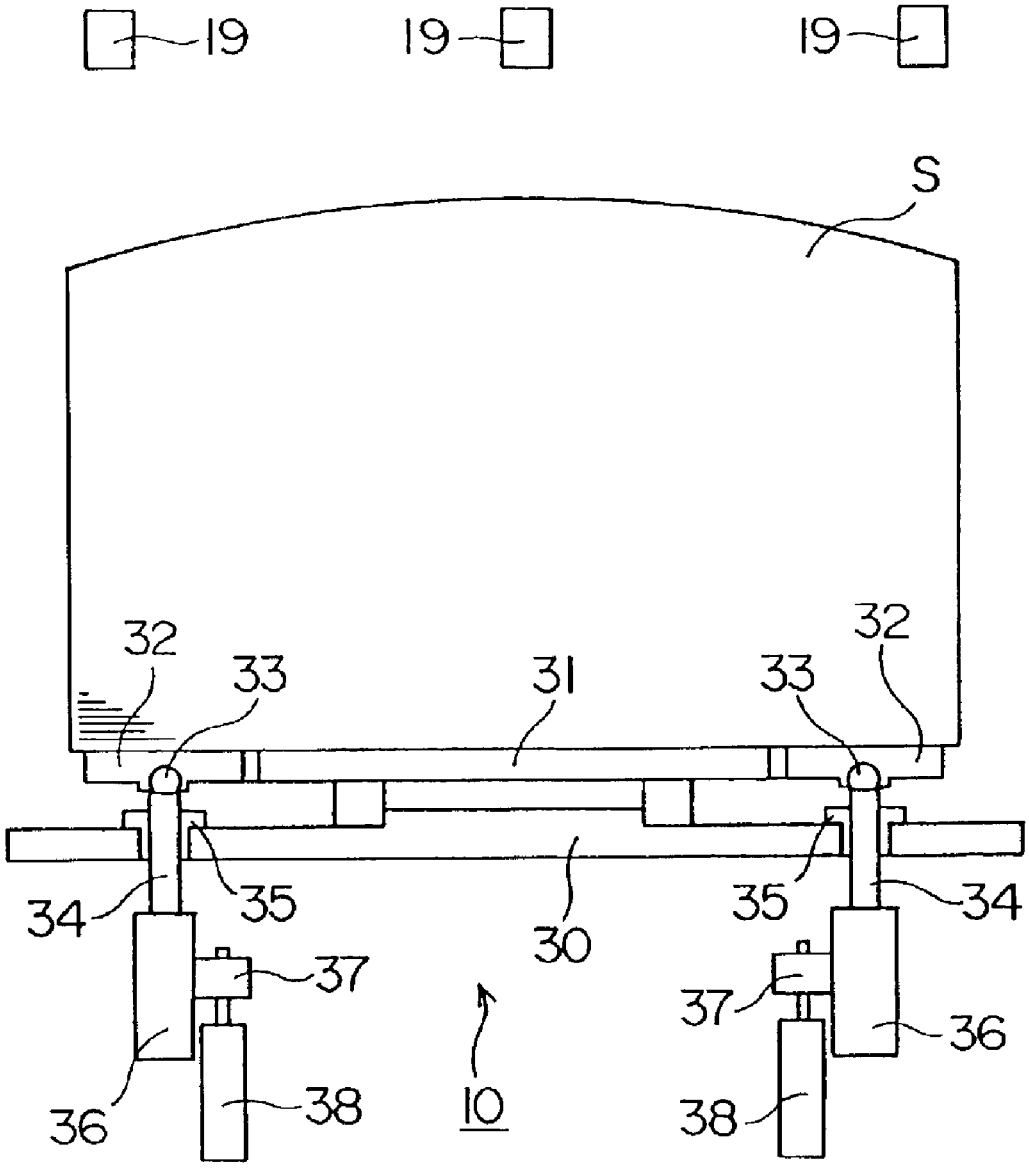
FIG. 2 is a front view showing a principal portion of a paper tray and adjacent components.
Figure 3:
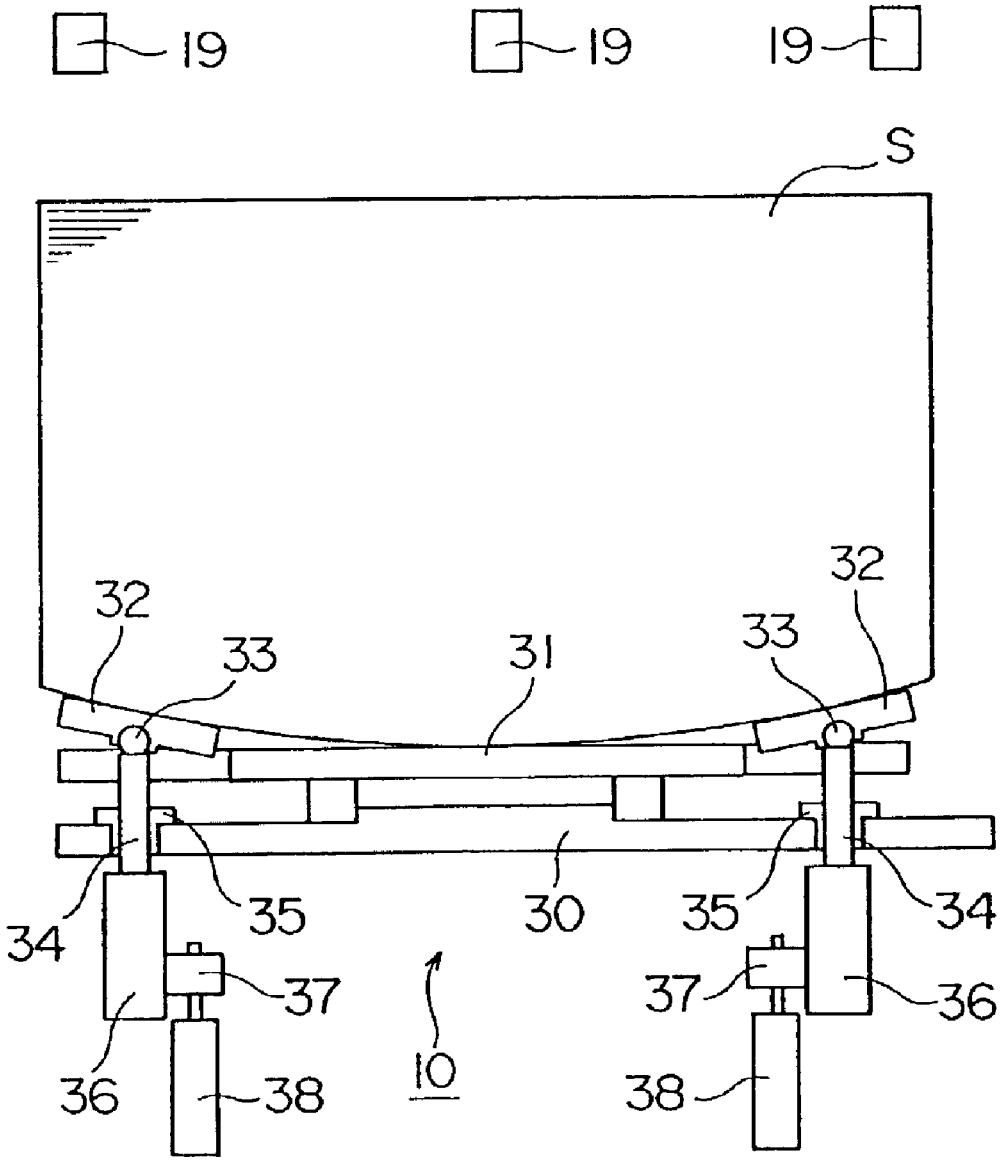
FIG. 3 is another front view showing the principal portion of the paper tray and adjacent components.
Figure 4:
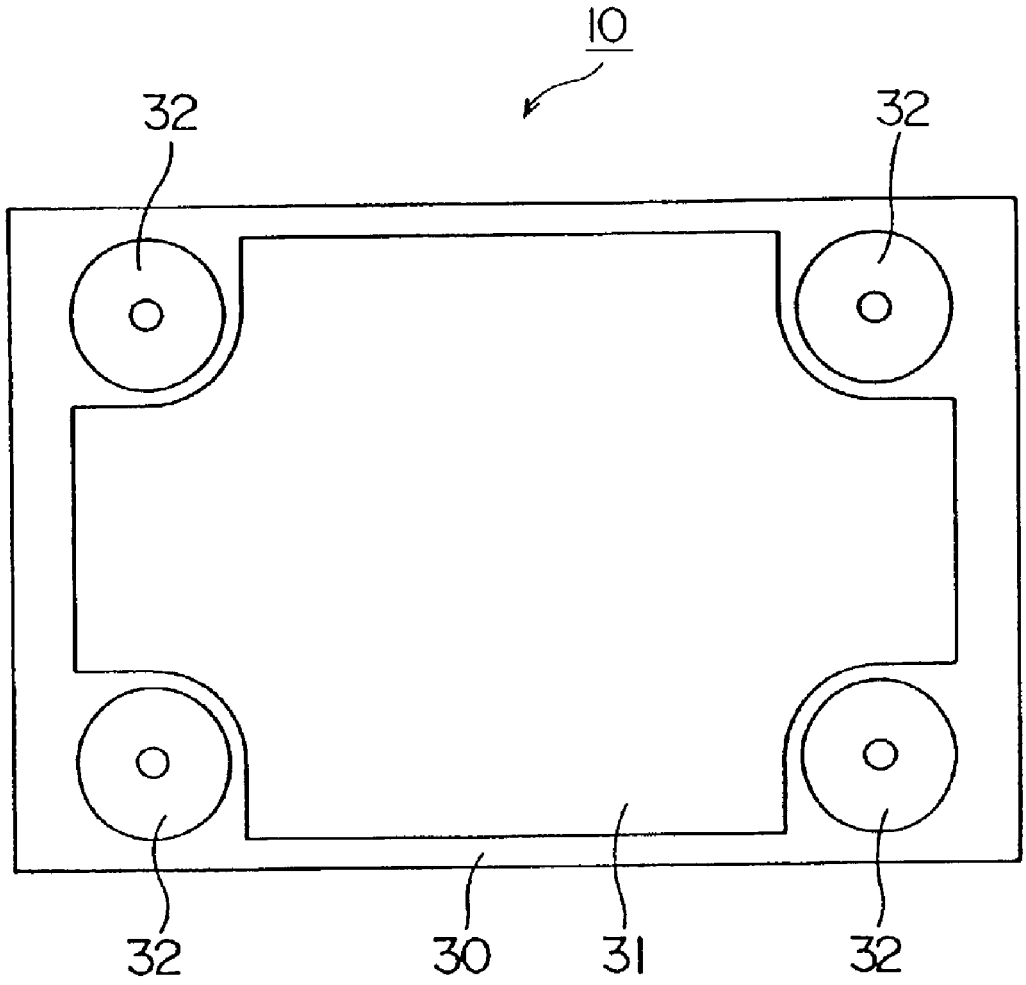
FIG. 4 is a schematic plan view of the paper tray.

The construction of the paper tray 10 will be described next. FIGS. 2 and 3 are front views showing a principal portion of the paper tray 10. FIG. 4 is a schematic plan view of the paper tray 10.

The paper tray 10 of the paper feeding apparatus according to the present invention includes a base 30, a first support member 31 fixedly mounted on the base 30 for supporting the central area of the lower surface of printing paper S, and second support members 32 arranged in cutouts formed in corners of the first support member 31 for supporting corner areas of the lower surface of printing paper S.

Each of the second support members 32 is connected to a lift screw 34 through a ball joint 33. The lift screw 34 is meshed with a nut 35 fixed to the base 30. The lift screw 34 is connected at a lower end thereof to a gear 36. The gear 36 is meshed with a pinion 37 rotatable by a motor 38.

When the motor 38 rotates the gear 36 through the pinion 37, the lift screw 34 moves vertically while rotating at the same time. With the vertical movement of the lift screw 34, each second support member 32 connected to the upper end of lift screw 34 through the ball joint 33 moves between a lower position shown in FIG. 2 and an upper position shown in FIG. 3.

Figure 5:
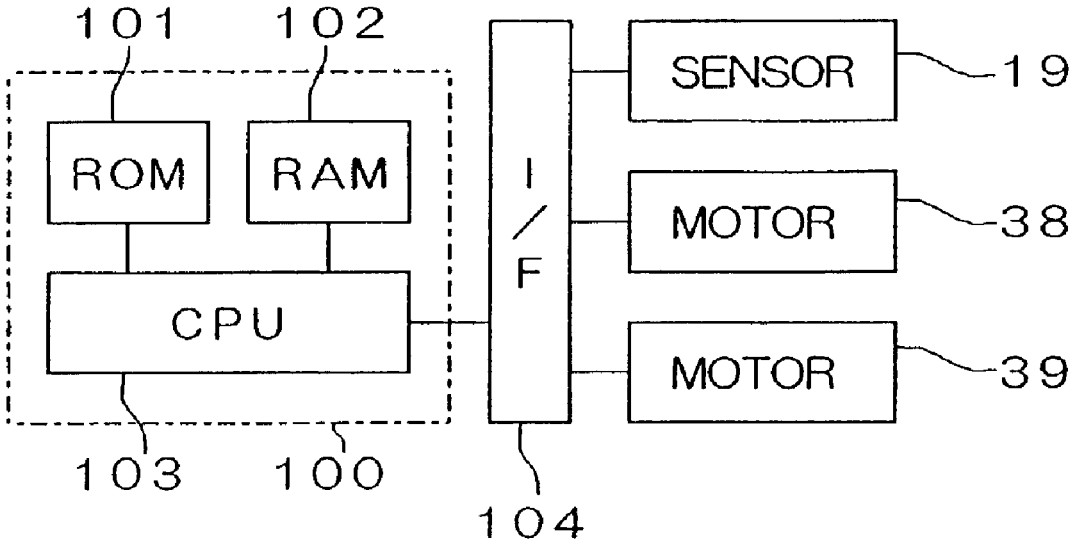
FIG. 5 is a block diagram showing a main electrical arrangement of the paper feeding apparatus in the first embodiment of the invention.

FIG. 5 is a block diagram showing a main electrical arrangement of the paper feeding apparatus in the first embodiment of the invention.

This paper feeding apparatus includes a controller 100 having a ROM 101 storing an operating program necessary for control of the apparatus, a RAM 102 for temporarily storing data and the like in time of control, and a CPU 103 for performing logical operations. The controller 100 is connected through an interface 104 to the sensors 19 shown in FIGS. 1 through 3. The controller 100 is connected through the interface 104 also to the motors 38 for vertically moving the second support members 32. Further, the controller 100 is connected through the interface 104 to the motor 39 for vertically moving the paper tray 10.

A paper feeding operation of the paper feeding apparatus having the above construction will be described next.

When printing the back surface of printing paper S with the front surface already printed, the printing paper S is placed one sheet over another on the paper tray 10. The height of the second support members 32 is adjusted in advance so that, as shown in FIG. 2, the surfaces of the second support members 32 are flush with the surface of the first support member 31. In this state, the printing paper S has an image-bearing central area thereof swelling upward, owing to the thickness of ink, relative to marginal areas. Thus, as shown in FIG. 2, the upper surface of the printing paper is convexed.

Next, the motors 38 are driven under control of the controller 100 to rotate the gears 36 through the pinions 37, thereby raising the lift screws 34 along with the second support members 32 connected to the upper ends thereof. The height of the upper surface of printing paper S is constantly monitored by the sensors 19, and the motors 38 are stopped when the upper surface of printing paper S is made level.

In this state, as shown in FIG. 3, the four corners of printing paper S are raised by the second support members 32 to level the upper surface of printing paper S. Each second support member 32 is tiltably connected to the lift screw 34 through the ball joint 33. Consequently, the second support members 32 tilt to extend along the lower surface in the corner areas of printing paper S.

In this state, the printing paper S is fed to the printing machine. In time of the paper feeding operation, each sheet of the printing paper S on the paper tray 10 is picked up adjacent an edge of the upper surface thereof by the suction pad 17 of sucker 18, and is transported in this state to the position to be pinched between the roller pair 12. Then, the sheet of printing paper S is transported by the transport mechanism having the plurality of roller pairs 12, 13 and 14 and endless belt 16, to the printing machine at the downstream stage.

The height of the upper surface of printing paper S varies with a decrease of the printing paper S on the paper tray 10 accompanying the paper feeding operation. In response to detection signals from the sensors 19 indicating the heights of the upper surface of printing paper S, the controller 100 controls the motors 38 and 39 to adjust the height of the entire upper surface of printing paper S to a position for enabling a proper paper feeding operation by the sucker 18.

Specifically, based on the signal from the sensor 19 that detects the height of the central area of printing paper S, the motor 39 is driven to raise the paper tray 10 gradually to adjust the overall height of paper tray 10. Based on the signals from the sensors 19 that detect the height at the opposite ends of printing paper S, the motors 38 are controlled for slightly lowering the corners of printing paper S relative to the central area, thereby to adjust the entire upper surface of printing paper S to be level.

By repeating the above operation as each sheet of printing paper S is fed, the entire upper surface of printing paper S is maintained at a proper height to enable a steady printing operation.

In the above embodiment, the controller 100 controls the motors 38, based on the signals from the sensors 19, to move the second support members 32 vertically. However, the second support members 32 may be moved vertically based on the number of sheets of printing paper S for which a printing operation is completed.

Figure 6:
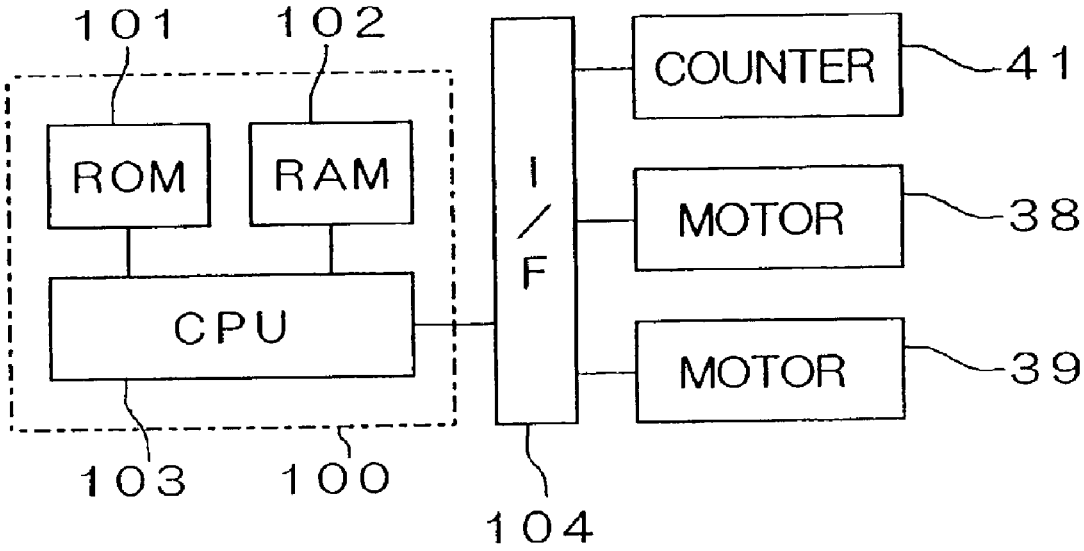
FIG. 6 is a block diagram showing a main electrical arrangement of a paper feeding apparatus in a second embodiment of the invention.

FIG. 6 is a block diagram showing a main electrical arrangement of a paper feeding apparatus in a second embodiment of the invention having such an arrangement.

The sensors 19 in the paper feeding apparatus in the first embodiment are omitted from the paper feeding apparatus in the second embodiment. Instead, a counter 41 is provided for counting the number of sheets of printing paper S for which a printing operation is completed. The other aspects are the same as in the first embodiment described hereinbefore.

In the paper feeding apparatus in the second embodiment, a relationship between the number of sheets of printing paper S and the curve of the upper surface of printing paper S is measured beforehand. By counting, with the counter 41, the number of sheets of printing paper S for which a printing operation is completed, the number of sheets of printing paper S on the paper tray 10 is confirmed. Based on a curved state of printing paper S at that time, the controller 100 determines a height to which the second support members 32 should be set, and then controls the motors 38 to move the second support members 32 to the proper height.

Consequently, as in the paper feeding apparatus in the first embodiment, the entire upper surface of printing paper S is maintained at a proper height to enable a steady printing operation.

In the first embodiment, heights of printing paper S is detected in a noncontact mode by the sensors 19. It is desirable that the sensors 19 are disposed adjacent the sucker 18 to detect the heights of printing paper S from the forward end of printing paper S. However, the forward end of printing paper S levitates where a construction is employed to fan the printing paper S with air. In such a case, a contact type sensor such as a microswitch may be used to press on the upper surface of printing paper S to detect a height thereof each time a sheet is transported. Where a height of printing paper S is detected by using the contact type sensor, the height may be detected at a substantially central portion of printing paper S in order not to affect the operation to fan the printing paper S. Information on the height of printing paper S detected in this way may be used for adjusting the height of printing paper S as a whole by means of the motor 39.

In the foregoing embodiments, the upper surface of printing paper S is leveled by raising the second support members 32 supporting the lower surface at the four corners of printing paper S. Alternatively, the upper surface of printing paper S may be leveled by fixing the second support members 32 and lowering the first support member 31 supporting the lower surface in the central area of printing paper S.

In the foregoing embodiments, the second support members 32 support the lower surface at the four corners of printing paper S to adjust height. Instead, height adjustment may be provided only for the two corners adjacent the sucker 18. The height may be adjusted by supporting not only the corners but the lower surface along the entire end area adjacent the sucker 18.

In the foregoing embodiments, the lift screws 34 are rotated by the motors 38 for vertically moving the second support members 32. Such lift screws may be rotated manually.

In the foregoing embodiments, the printing paper S is transported with the forward end thereof picked up and held by the sucker 18. Instead, the printing paper S may be transported with the rear end thereof held by the sucker 18.

Further, instead of picking up and transporting the printing paper S by the sucker 18 as in the foregoing embodiments, the printing paper S may be fed by a transport roller or rollers contacting the upper surface thereof. In this case, the height of printing paper S may be adjusted to level the end area of printing paper S contacted by the transport roller or rollers.

The present invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2001-371146 filed in the Japanese Patent Office on Dec. 5, 2001, the entire disclosure of which is incorporated herein by reference.

What is claimed is:

1. A paper feeding apparatus for transporting an uppermost sheet and then a next sheet of printing paper placed on a paper tray to a printing machine, comprising:

a first support member for supporting a partial area of a lower surface of the printing paper placed on the paper tray;

second support members for supporting areas of the lower surface of the printing paper placed on the paper tray other than the area supported by said first support member; and a moving mechanism for vertically moving said second support members relative to said first support member, and further comprising:

a sucker for transporting the printing paper by picking up an upper surface thereof, said second support members supporting the lower surface at least at corners of the printing paper picked up by said sucker; and a counter for counting the number of sheets of the printing paper for which a printing operation is completed, said moving mechanism vertically moving said second support members based on a signal from said counter.

2. A paper feeding apparatus for transporting printing paper, with an upper surface thereof picked up by a sucker, placed on a paper tray to a printing machine, comprising:

a first support member for supporting a central area of a lower surface of the printing paper placed on the paper tray;

second support members for supporting corner areas of the lower surface of the printing paper placed on the paper tray; and a moving mechanism for vertically moving said second support members relative to said first support member, and further comprising:

a counter for counting the number of sheets of the printing paper for which a printing operation is completed, said moving mechanism vertically moving said second support members based on a signal from said counter.

* * * * *